US005209127A

United States Patent [19]

Milliner et al.

[11] Patent Number: 5,209,127

[45] Date of Patent: May 11, 1993

[54] DEVICE FOR RECEIVING AND TRANSFERRING CYLINDRICAL FILTER RODS FROM A MASS FLOW OF FILTER RODS BEING CONVEYED

[75] Inventors: Kenneth M. Milliner; Tommy J. Hinzman; Everett N. Finn; Byron L. Lowe, all of Macon, Ga.

[73] Assignee: Brown & Williamson Tobacco Corp., Louisville, Ky.

[21] Appl. No.: 493,267

[22] Filed: Mar. 14, 1990

[51] Int. Cl.[5] ..... A24C 5/33; G01N 1/02

[52] U.S. Cl. ..... 73/863.91; 131/282; 209/535

[58] Field of Search ..... 73/863.91; 131/282, 131/906, 908; 209/535

[56] References Cited

U.S. PATENT DOCUMENTS

| | | | |
|---|---|---|---|
| 1,432,762 | 10/1922 | Ladd | 131/282 |
| 3,492,874 | 2/1970 | Marradi | 73/863.91 |
| 3,785,487 | 1/1974 | Spencer | 209/535 |
| 4,454,943 | 6/1984 | Moller | 73/863.91 |
| 4,557,125 | 12/1985 | Schaumburg | 73/863.91 |
| 4,619,149 | 10/1986 | Long | 73/863.91 |
| 4,760,853 | 8/1988 | Gamberini | 131/282 |
| 4,825,994 | 5/1989 | Gömann et al. | 131/282 |
| 4,882,938 | 11/1989 | Neri | 73/863.91 |
| 4,962,771 | 10/1990 | Neri et al. | 73/863.91 |
| 5,024,333 | 6/1991 | Brink et al. | 209/535 |

*Primary Examiner*—Hezron E. Williams
*Assistant Examiner*—George Dombroske
*Attorney, Agent, or Firm*—Charles G. Lamb

[57] ABSTRACT

A device for receiving and transferring cylindrical filter rods one at a time from a mass flow of filters. The receiving and transferring device is used to remove filter rods from the mass flow of filter rods to conduct, for example, quality control checks on the filter rods without interrupting production of the filter rods.

5 Claims, 4 Drawing Sheets

DEVICE FOR RECEIVING AND TRANSFERRING CYLINDRICAL FILTER RODS FROM A MASS FLOW OF FILTER RODS BEING CONVEYED

BACKGROUND OF THE INVENTION

1. Field of the Invention

The present invention relates to article conveying or transfer devices, and particularly to an article transfer device for removing articles one at a time from a mass flow of articles.

2. Discussion of the Prior Art

The present invention has particular utility in the manufacture of filtered cigarettes. Cigarette filters are cylindrical in shape and are manufactured at very high production rates. After the filters are manufactured, they are conveyed in mass to a downstream manufacturing operation where they are attached to cigarette tobacco rods to produce filtered cigarettes. It is important that the filters be randomly checked to make sure they conform to preselected quality and performance standards. The problem is to be able to remove a filter from the mass flow of filters being conveyed without interfering with the flow of filters in any way which would slow down the overall manufacturing process.

For example, U.S. Pat. No. 3,034,645 teaches in FIG. 1 the use of air blower nozzles 38, 40 for ejecting defective cigarettes. U.S. Pat. No. 3,450,258 teaches in FIG. 1 a pusher element 2 to deflect defective cigarettes from conveyor belt 28 (FIG. 3). U.S. Pat. No. 3,729,636 teaches in FIG. 1 a system comprising a conveyor 12 with filter tipped cigarettes 18 thereon, a fiber optic bundle 20 to inspect cigarettes, and a reject mechanism 36 using an air blast to eject the defective cigarettes. U.S. Pat. No. 3,785,487 teaches in FIG. 2 a restriction die unit 10 for detecting and capturing imperfect filter rods 18. U.S. Pat. No. 4,010,678 teaches in FIG. 4 a filter plug length measuring device 28 which controls an ejecting device 29 for expelling unsatisfactory condensed groups. U.S. Pat. No. 4,093,075 teaches in FIG. 1 an air ejection system for rejecting faulty cigarettes. U.S. Pat. No. 4,376,484 teaches in FIG. 1 a hopper of a cigarette machine provided sensor means for checking cigarettes and a pusher bar 8 for ejecting the defective ones. U.S. Pat. No. 4,398,546 teaches an inspection system provided with means for ejecting faulty cork patches. U.S. Pat. No. 4,403,620 teaches a system for inspecting and ejecting defective cigarettes. U.S. Pat. No. 4,445,520 teaches in FIG. 1 a cigarette testing device 10*a* in which defective cigarettes 15 are ejected by air nozzles 24. U.S. Pat. No. 4,489,736 teaches in FIG. 2 an air nozzle 20 for ejecting a defective cigarette. U.S. Pat. No. 4,574,646 teaches in FIGS. 1 and 2 an apparatus for sampling cigarettes on a filter assembly machine, including a conveyor 18 for moving cigarettes 7 from station 23 to reject station 14. U.S. Pat. No. 4,648,232 teaches in FIG. 1 an apparatus for checking the quality of rod-shaped, cylindrical objects and an ejection mechanism is provided for removing faulty cigarettes. U.S. Pat. No. 4,667,831 teaches in FIG. 1 a device for feeding cigarettes into a hopper where sensors check the cigarettes and a pusher element 8 is used to reject defective cigarettes. And, U.S. Pat. No. 4,693,374 teaches in FIGS. 1–4 a mechanism which includes extracting device 41 for extracting defective cigarettes from hopper 1.

SUMMARY OF THE INVENTION

The present invention provides a straightforward solution to the problem of extracting cylindrical articles, particularly cigarette filters, one at a time from a mass flow of such filters without interfering with or interrupting the flow of said articles and delivering to a quality gauge.

More particularly, the present invention provides a device for receiving and transferring cylindrical articles one at a time from a mass flow of parallel articles being conveyed in a direction transverse to their longitudinal axis comprising a stationary first semi-cylindrical filter receiving body disposed across the conveying path with its longitudinal axis transverse to the conveying path such that it is parallel to the longitudinal axis of the cylindrical articles being conveyed and concavely facing in the upstream direction of the conveying path, the inside radius of the first semi-cylindrical body being substantially equal to the radius of the cylindrical articles; a rotatable second semi-cylindrical body longitudinally coextensive with and concentrically disposed with the first semi-cylindrical body and having an inside radius substantially equal to the outside radius of the first semi-cylindrical body; means for rotating the second semi-cylindrical body between a first position wherein the second semi-cylindrical body overlaps the first cylindrical body and a second position wherein the second semi-cylindrical body concavely faces the first semi-cylindrical body defining a generally cylindrically shaped enclosure between the first and second semi-cylindrical bodies; and, means for moving a cylindrical article captured in the generally cylindrically shaped enclosure longitudinally thereof and out of the enclosure through an open exit end thereof.

BRIEF DESCRIPTION OF THE DRAWINGS

A better understanding of the present invention will be had upon reference to the following discussion in conjunction with the accompanying drawings wherein like numerals refer to like parts throughout the several views and wherein.

DETAILED DESCRIPTION OF THE PREFERRED EMBODIMENT

Figure 6:
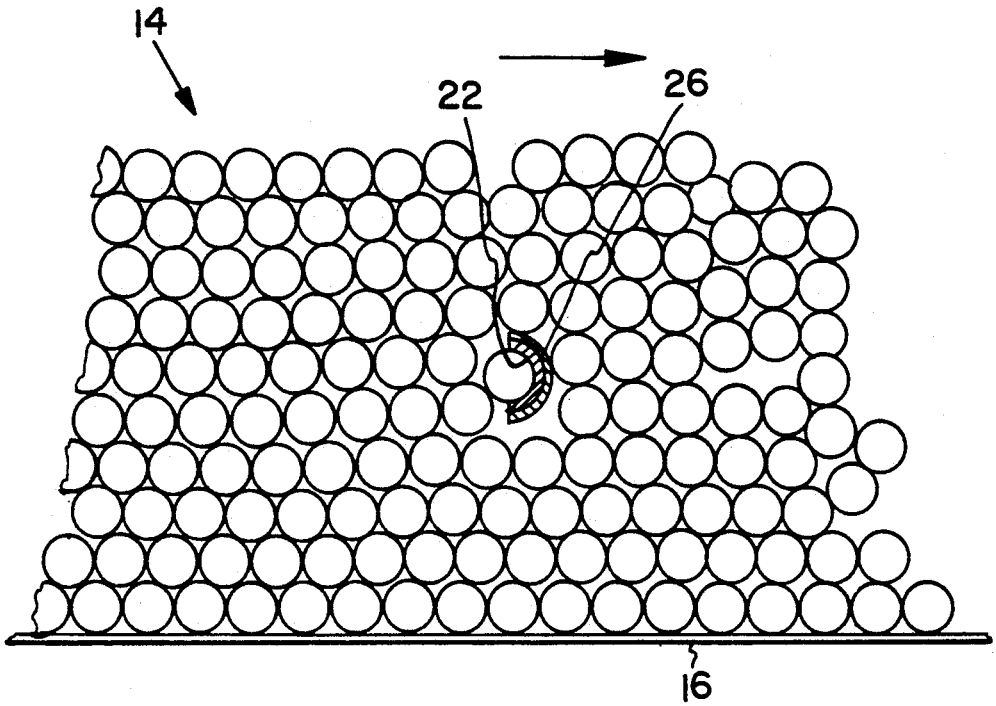
FIG. 6 is an end view of the device of FIG. 1 disposed in a mass flow of articles being conveyed with the movable component in a first position relative to the fixed component.
Figure 7:
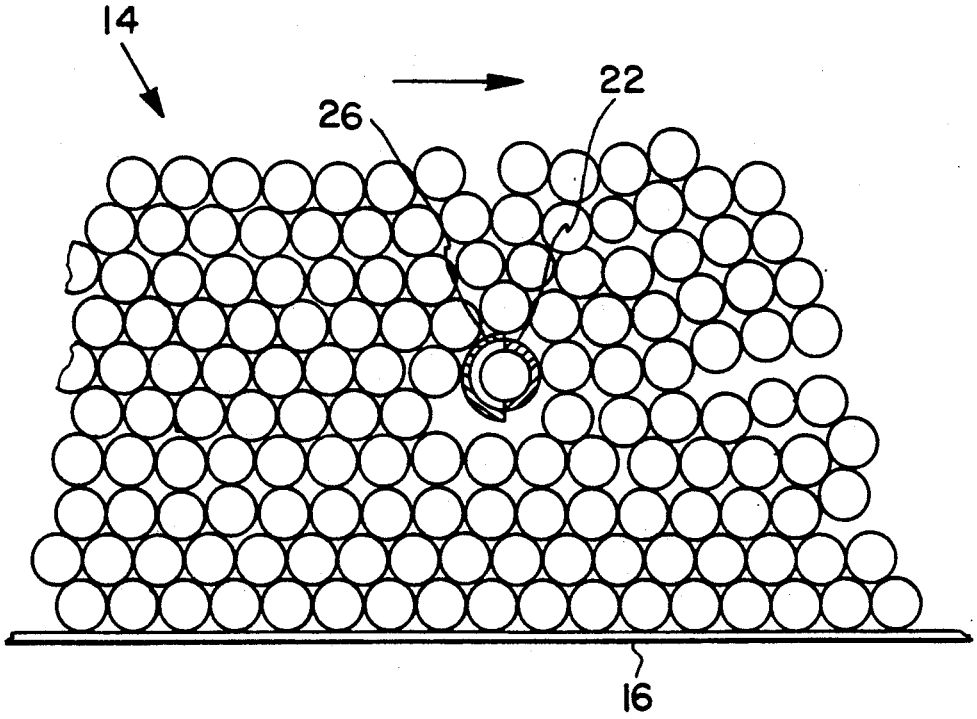
FIG. 7 is an end view of the device of FIG. 1 disposed in a mass flow of articles being conveyed with a movable component in a second position relative to a fixed component; and, FIG. 8 is a schematic longitudinal front view of another embodiment of the receiving and transferring device of the present invention.

With reference to FIGS. 1–7, there is shown a device, generally denoted as the numeral 10, for receiving and transferring cylindrical articles 22, such as cigarette filters, one at a time from a mass flow of parallel cylindrical articles 12 being conveyed in a direction transverse to their longitudinal axes, as can be best seen in FIGS. 6 and 7. The device 10 is particularly well suited for extracting cigarette filters one at a time from a mass flow of cigarette filters and transferring the extracted cigarette filter to a testing station.

Figure 1:
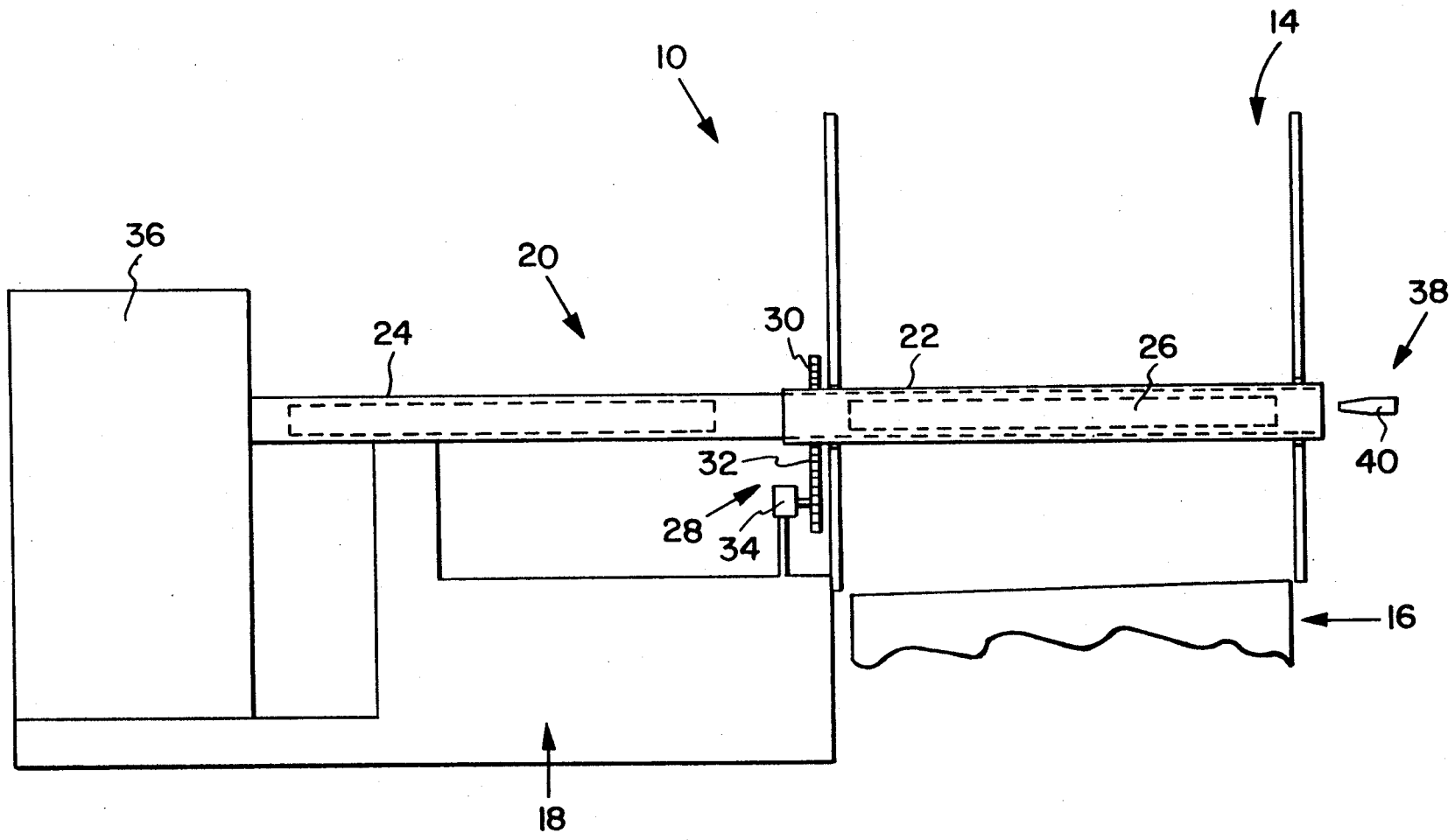
FIG. 1 is a schematic longitudinal front view of the receiving and transferring device of the present invention located with a conveying trough.

With reference to FIGS. 1, 6, and 7, there is shown a cigarette filter receiving and transferring device 10 of the present invention positioned transversely across a cigarette filter conveyor trough 14 which is located above a conveyor device 16. A mass of cigarette filters are moved on the conveyor device 16 inside the trough 14 with their longitudinal axes transverse to the conveyor trough 14.

Figure 2:
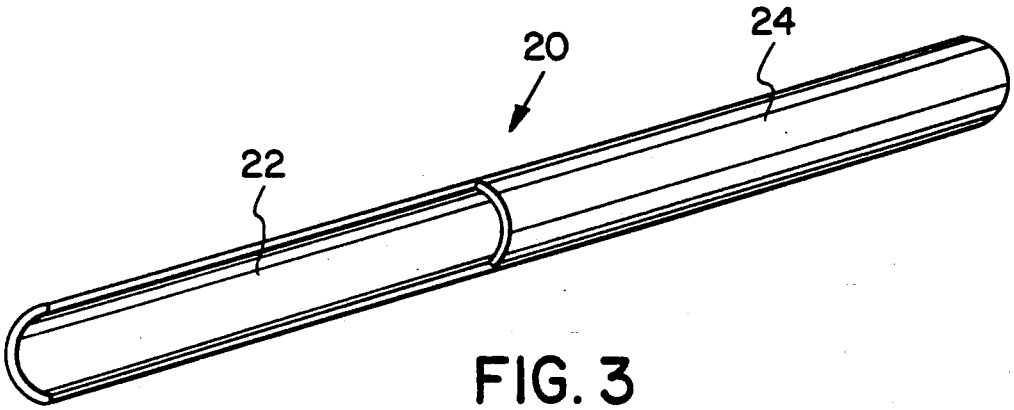
FIG. 2 is a perspective view of a fixed component of the present invention.
Figure 3:
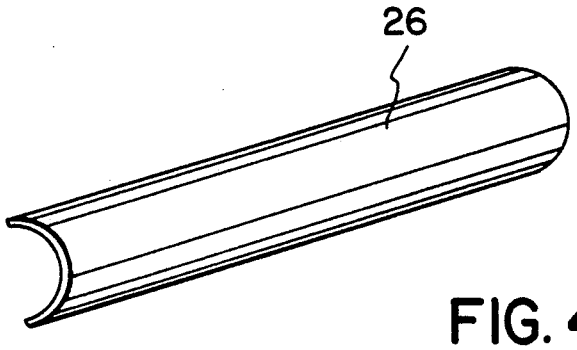
FIG. 3 is a perspective view of a movable component of the present invention.

As shown in FIGS. 1 and 2, the cigarette filter receiving and transferring device 10 includes a framework 18 adjacent the conveyor trough 14. A stationary tubular member 20 is attached to the framework 18 perpendicular to the trough 14. The stationary tubular member 20 includes a first semi-cylindrical filter receiving body, or distal section 22, and a cylindrical body, or proximal section 24 coaxial with the first semi-cylindrical filter receiving body 22. The first semi-cylindrical filter receiving body 22 has as inside radius approximately equal to the radius of a cigarette filter, and is longer than the width of the trough 14, and, therefore, longer than the length of a cigarette filter. The cylindrical body 24 also has an inside radius approximately equal to the radius of a cigarette filter. The stationary first semi-cylindrical filter receiving body 22 is disposed entirely across the conveying path defined by the trough 14 of the mass of filters with its longitudinal axes transverse to the conveying path such that it is parallel to the longitudinal axes of the cigarette filters being conveyed, and concavely faces in the upstream direction of the conveying path. The cylindrical body 24 extends transversly outwardly from the side of the trough 14 and is secured to the framework 18.

With reference to FIGS. 1 and 3–7, the cigarette filter receiving and transferring device 10 further includes a rotatable second semi-cylindrical body 26 longitudinally co-extensive with and concentrically disposed with the first semi-cylindrical body 22. The second semi-cylindrical body 26 has an inside radius substantially equal to the outside radius of the first semi-cylindrical body 22.

With reference to FIGS. 1 and 4–7, the second semi-cylindrical body 26 is rotatably movable relative to the first semi-cylindrical body 22 about their coaxes between a first position (see FIGS. 4 and 6) wherein the second semi-cylindrical body 26 concavely overlaps the first semi-cylindrical body 22 and a second position (see FIGS. 5 and 7) wherein the second semi-cylindrical body 26 concavely faces the first cylindrical body 22 defining a generally cylindrically shaped enclosure between the first cylindrical body 22 and second semi-cylindrical body 26.

With reference to FIG. 1, the device 10 also includes means, generally denoted as the numeral 28, for rotating the second semi-cylindrical body 26 between the first position and the second position. The rotating means 28 can be of virtually any type such as, for example, a rotary activator, sheave and belt drive, or rack and pinion drive, and the like. As shown in FIG. 1, for illustration purposes, the rotating means 28 consists of a driven gear 30 coaxially attached to the second semi-cylindrical body 26 and a drive gear 32 in meshing engagement with the driven gear 30. The drive gear 32 can be driven in both clockwise and counter-clockwise directions by, for example, a small reversible electric motor 34.

A filter gauge 36 is located at an open exit end of the cylindrical body 24 of the tubular member 20, that is, the end of the tubular member 20 opposite the first semi-cylindrical body 22, for receiving filter rods therefrom for checking for quality and performance standards. The filter gauge 36 does not comprise a part of this invention, and such gauges are known. Therefore, for the sake of brevity, the filter gauge 36 will not be further described.

With reference once again to FIG. 1, the cigarette filter receiving and transferring device 10 also includes means, generally denoted as the numeral 38, for moving a cigarette filter captured in the generally cylindrically shaped enclosure, defined by the first semi-cylindrical body 22 and second semi-cylindrical body 26 when the second semi-cylindrical body 26 is in the second position, longitudinally thereof and out of the tubular member 20 and into the filter gauge 36. As shown, the cigarette filter moving means 38 includes air injection means 40, such as an air nozzle, positioned at the end of the tubular member 20 opposite the filter exit end thereof, and is operatively associated with a source of compressed air (not shown), for creating an air flow through the enclosure and cylindrical body 24 in a direction toward the open filter exit end of the tubular member 20 by injecting an air stream into the enclosure.

Figure 8:
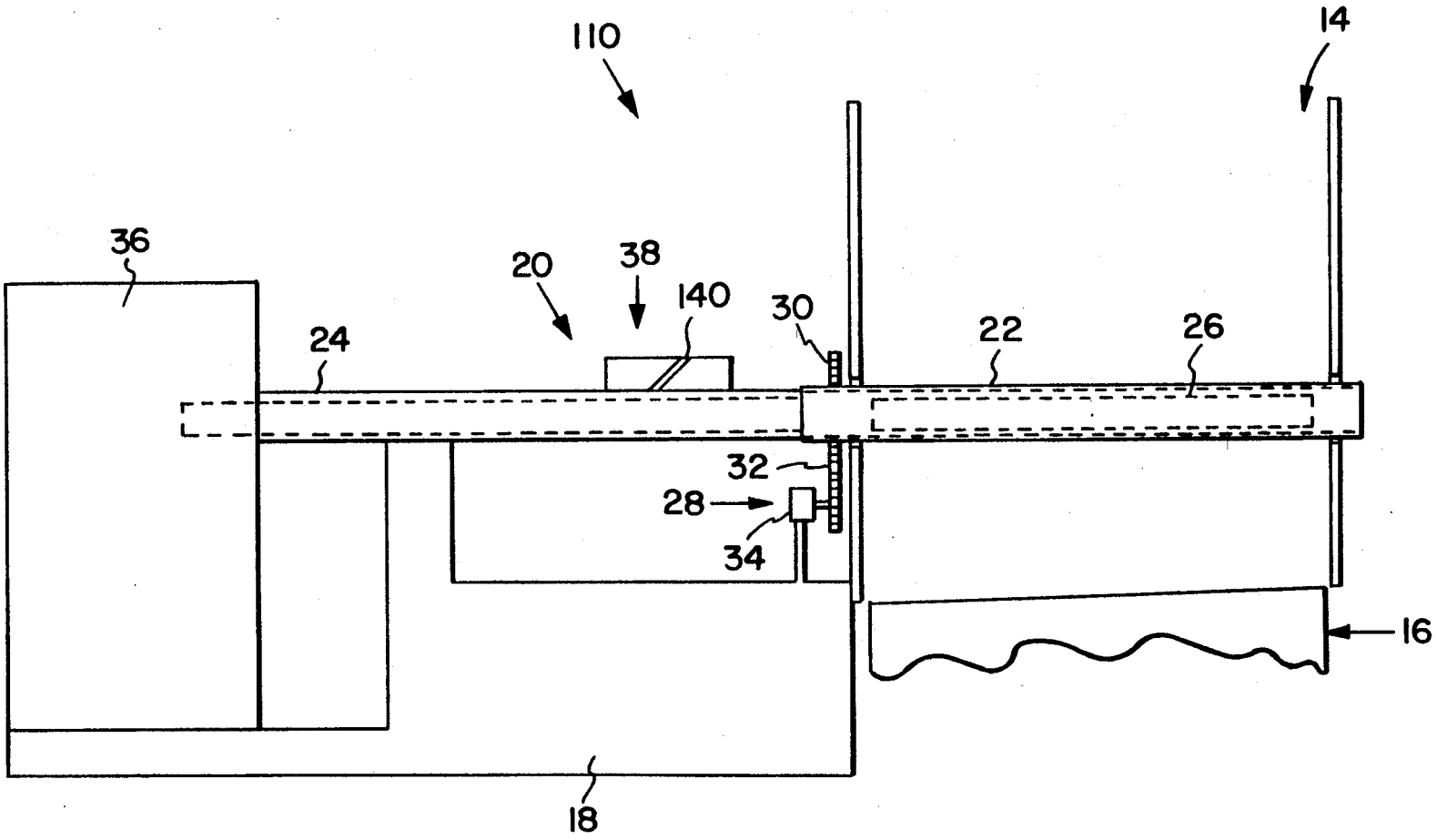

With reference to FIG. 8, there is shown a cigarette filter receiving and transferring device, generally denoted as the numeral 110, which has most of its features in common with the filter receiving and transferring device 10 of FIG. 1.

Therefore, for the sake of brevity, the common features are denoted by identical numerals and the description thereof will not be repeated. The only difference between the filter receiving and transferring device 110 and the filter receiving and transferring device 10 resides in the filter moving means 38. In the filter receiving and transferring device 110, the filter moving means 38 comprises a venturi 140 formed in the wall of the cylindrical body 24 and is operatively associated with a source of compressed air (not shown). The air passing from the venturi 140 into the cylindrical body 24 creates an air flow through the enclosure defined by the first semi-cylindrical body 22 and second cylindrical body 26 creates an air flow through the enclosure in a direction toward the open filter exit end of the tubular member 20 by creating a vacuum in the cylindrical body member 22.

Figure 4:
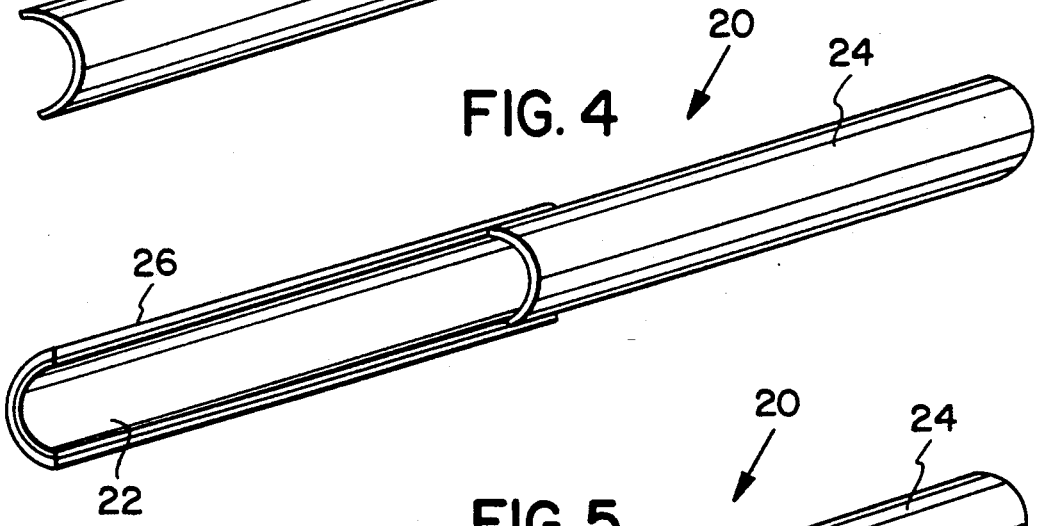
FIG. 4 is a perspective view of two components of the FIGS. 1, 2, and 3 assembled together with the movable component in the first position relative to the fixed components.
Figure 5:
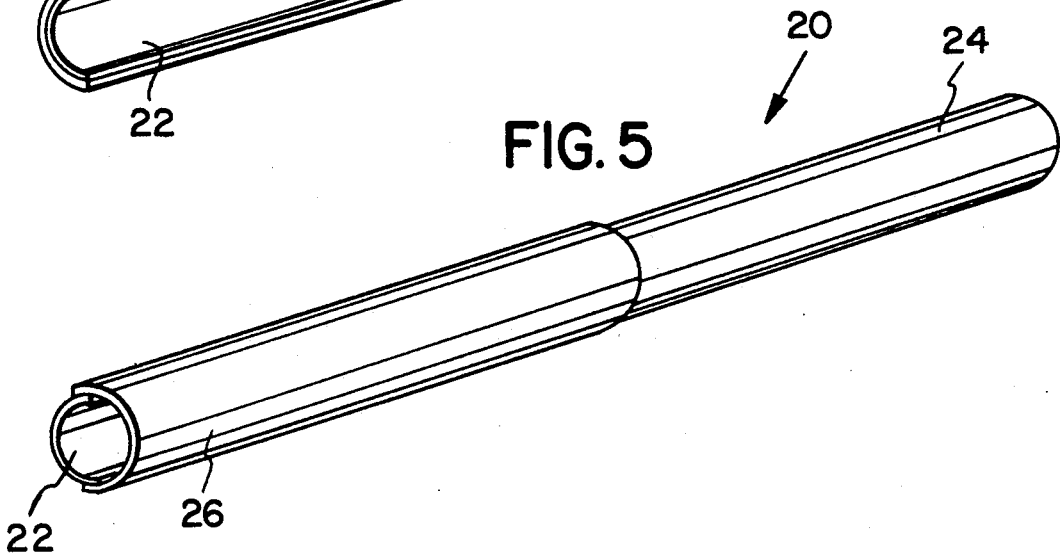
FIG. 5 is a perspective view of two components of FIGS. 2 and 3 assembled together with a movable component in the second position relative to a fixed component.

In operation of the filter receiving and transferring device 10, 110, initially the second semi-cylindrical body 26 is in the first or open position of FIGS. 4 and 6. As the mass of cigarette filters moves on conveyor device 16 past the filter receiving and transferring device 10, 110, one of the filters will be received in the first semi-cylindrical body 22. The rotating means 28 is then activated to rotate the second semi-cylindrical body 26 to the second semi-cylindrical body 26 to the second or closed position capturing the filter in the cylindrical enclosure defined by the first and second semi-cylindrical bodies 22 and 26. The filter moving means 38 is then activated to create an air flow through the enclosure which conveys or moves the captured cigarette filter through the cylindrical body 24 and into the filter gauge 36. With reference to FIG. 1, the air injected into the tubular member 20 pushes the captured filter through the tubular member 20 into the filter gauge 36. With reference to FIG. 8, the air injected into the cylindrical body 24 creates a vacuum in the cylindrical body 24 downstream of the enclosure defined by the first and second semi-cylindrical bodies 22 and 26 which draws the filter from the enclosure into the cylindrical body 24. After the moving filter passes the venturi 140 in the cylindrical tubular body 24, the air entering the cylindrical body 24 from the venturi 140 pushes the filter the rest of the way through the cylindrical body 24 and out of the exit end into the gauge 36.

The foregoing detailed description is given primarily for clearness of understanding and no unnecessary limitations are to be understood therefrom for modifications will become obvious upon reading this disclosure and can be made without departing from the spirit of the invention and scope of the appended claims.

What is claimed is:

1. A device for receiving and transferring cylindrical articles having a preselected radius one at a time from a mass flow of parallel articles being conveyed along a conveying path in a direction transverse to their longitudinal axes comprising:

a stationary first semi-cylindrical filter receiving body disposed across the conveying path with its longitudinal axis transverse to the conveying path such that it is parallel to the longitudinal axis of the cylindrical articles being conveyed and concavely facing in the upstream direction of the conveying path, the inside radius of the first semi-cylindrical body being substantially equal to the radius of the cylindrical articles;

a rotatable second semi-cylindrical body substantially longitudinally coextensive with and concentrically disposed with the first semi-cylindrical body and having an inside radius substantially equal to the outside radius of the first semi-cylindrical body;

means for rotating the second semi-cylindrical body between a first position wherein the second semi-cylindrical body overlaps the first semi-cylindrical body and a second position wherein the second semi-cylindrical body concavely faces the first semi-cylindrical body defining a generally cylindrically shaped enclosure between the first and second semi-cylindrical bodies; and, means for moving a cylindrical article captured in the generally cylindrically shaped enclosure longitudinally thereof and out of the generally cylindrically shaped enclosure through an open exit end thereof.

2. The device of claim 1, further comprising means for creating an air flow through the enclosure.

3. The device of claim 2, wherein the means for creating the air flow comprises means for creating a low pressure zone at the open exit end of the enclosure through which the captured articles exit the enclosure.

4. The device of claim 2, wherein the means for creating the comprises means for injecting an air stream into the enclosure through an open end thereof opposite the open exit end.

5. The device of claim 1, wherein the means for rotating the second semi-cylindrical body comprises a rotary actuator operatively associated with the second semi-cylindrical body.

* * * * *